US007255054B1

(12) United States Patent
DiGregorio

(10) Patent No.: US 7,255,054 B1
(45) Date of Patent: Aug. 14, 2007

(54) CACHE BOAT

(75) Inventor: Robert DiGregorio, Cutchogue, NY (US)

(73) Assignee: STIDD Systems, Inc., Greenport, NY (US)

( * ) Notice: Subject to any disclaimer, the term of this patent is extended or adjusted under 35 U.S.C. 154(b) by 0 days.

(21) Appl. No.: 11/180,449

(22) Filed: Jul. 13, 2005

(51) Int. Cl.
*B65D 88/78* (2006.01)
*B63G 8/00* (2006.01)
*B63G 8/22* (2006.01)

(52) U.S. Cl. ..... 114/256; 114/312; 114/333

(58) Field of Classification Search ..... 114/312, 114/317, 318, 320, 321, 330, 331, 333–335, 114/337
See application file for complete search history.

(56) References Cited

U.S. PATENT DOCUMENTS 3,416,478 A * 12/1968 Markham ..... 114/315
5,377,613 A * 1/1995 Wyman et al. ..... 114/332
2001/0025594 A1* 10/2001 Daniels ..... 114/315

* cited by examiner

*Primary Examiner*—Jesús D. Sotelo
(74) *Attorney, Agent, or Firm*—Schweitzer Cornman Gross & Bondell LLP

(57) ABSTRACT

A submersible surface-planing vessel has the capability to operate with a lowered profile on surface propulsion to lessen the visibility of the vessel, and sink to the bottom for temporary storage, followed by resurfacing and dewatering to operate as a planing craft. Surface propulsion is provided by an engine system which can be totally sealed when the vessel submerges. A buoyancy system, which may include both open and closed ballast tanks, permit the vessel to sink, refloat or to be of neutral buoyancy as required. The vessel is constructed to maintain the center of buoyancy above the vessel's center of gravity irrespective of the degree of fill of the ballast tanks to maintain the vessel in an upright orientation at all times when under water and transitioning between surface and submerged states.

13 Claims, 2 Drawing Sheets

CACHE BOAT

The present invention relates to a new and improved water vessel, and particularly to a watercraft designed for surface planing travel that has the ability to submerge in an unpowered state, rest or be cached at the bottom as desired, and then resurface to resume travel.

BACKGROUND OF THE INVENTION

Submersible watercraft or submarines are a highly sophisticated and well-established part of the navies of the world. A modern submarine permits extended undersea voyages for an extensive crew, allowing missions to be carried out with a high level of stealth and safety. While submarines are typically designed to be most efficient when traveling underwater, they are capable of both submerged and surface travel. Due to the vastly different hull characteristics required for efficient surface and subsurface travel, however, surface travel speed and efficiency is sacrificed to improve underwater performance. This is entirely reasonable, however, as the very purpose of a submarine suggests that its design should be to favor underwater travel.

There are situations, however, in which rapid deployment of a vessel may take precedence over the improved stealth characteristics associated with underwater travel, and it is well recognized that surface travel is significantly more efficient than underwater travel, and that much greater speeds can be obtained with a planing hull than a hull that is fully submerged. Yet even in such circumstances the ability to have the vessel submerged at some point in time can be of significant value. Particularly in the case of relatively small watercraft intended for military operations, the ability to maintain the vessel at the mission demarcation point in an undetected manner is substantially enhanced if the vessel is submerged. In such circumstances, the need for underwater travel is minimized. Major requisites of such a vessel are rapid surface travel coupled with the ability to submerge at a chosen location, remain submerged for an extended period of time, and then surface and leave the demarcation point in a rapid manner. Because the personnel compliment aboard is normally outfitted with self-contained, underwater breathing apparatus (scuba) the need for a water-tight enclosed quarters for the personnel is not required.

It is accordingly a purpose of the present invention to provide a surface-planing vessel having the capability of submerging, remaining below the surface for an extended period, and then resurfacing for further powered surface travel.

It is a further purpose of the present invention to provide such a submersible vessel having solely a surface propulsion system.

It is still a further purpose of the present invention to provide such a vessel in which the surface propulsion system can be fully sealed from the surrounding seas when stopped and the vessel submerged, and which can be easily and efficiently reconfigured for surface operation upon surfacing of the vessel.

Still a further purpose of the present invention is to provide a surface propelled vessel having the capability to operate in a semi-submerged configuration on surface propulsion to lessen the visibility of the vessel, and sink to the bottom for temporary storage, followed by resurfacing and de-watering to operate as a planing craft.

BRIEF DESCRIPTION OF THE INVENTION

In accordance with the foregoing and other objects and purposes, the present invention comprises a planing, open hull vessel, having a propulsion system adapted to drive the vessel at a planing speed while on the surface. Critical components of the drive system are maintained in a pressure-proof canister or container to protect the engine when submerged, and to permit rapid start of the engine upon resurfacing. Pass-through connections may couple the engine to needed auxiliary systems and provide a drive shaft output. A buoyancy control system, comprising ballast tanks and means for controlling the buoyancy of the tanks, permit the vessel to sink, refloat or to be of neutral buoyancy as required. The buoyancy control system may preferably comprise multiple sets of ballast tanks configured into first and second ballast systems. The first ballast system controls transition between surface running and awash conditions. The second ballast system adjusts the submerged depth, attitude and rate of descent and ascent of the vessel.

BRIEF DESCRIPTION OF THE DRAWINGS

A fuller understanding of the present invention will be obtained upon consideration of the following detailed disclosure of a preferred but nonetheless illustrative embodiment of the present invention, when reviewed in connection with the annexed drawings, wherein.

DETAILED DESCRIPTION OF THE INVENTION

Figure 1:
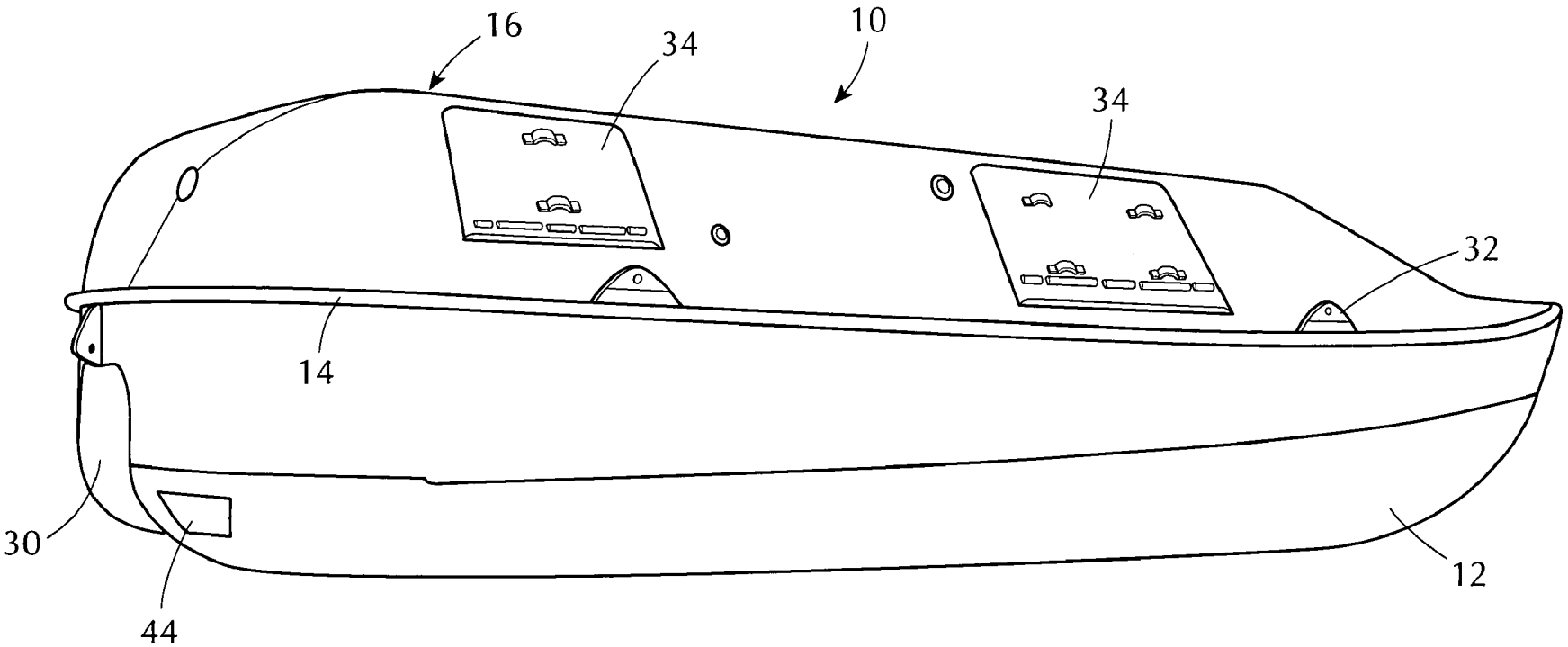
FIG. 1 is a side view of a vessel constructed in accordance with the present invention.
Figure 2:
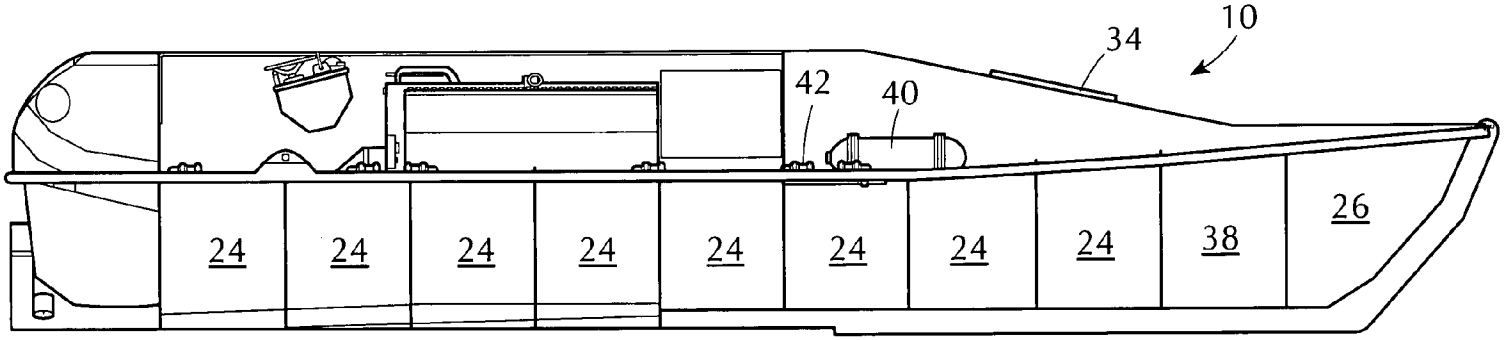
FIG. 2 is a schematic view taken along the center line of the vessel.
Figure 3:
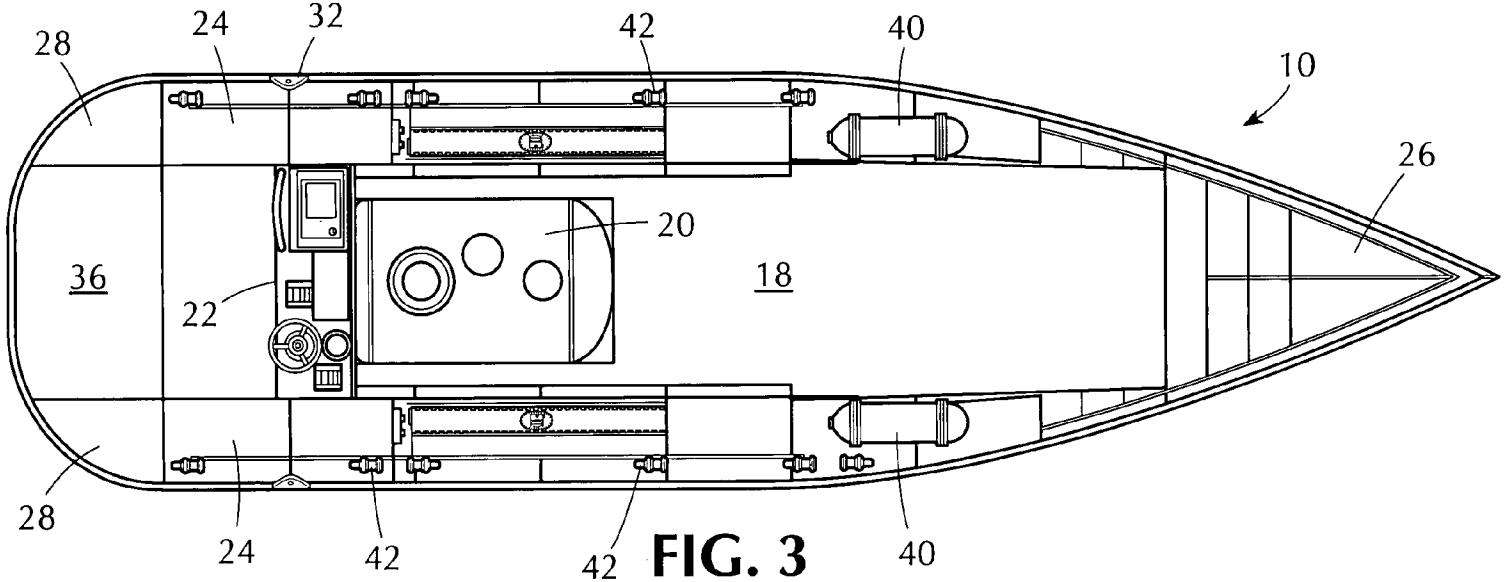
FIG. 3 is a top plan view of the vessel with the topskin removed.

As depicted in the Figures, vessel 10, which has been dubbed a "cache boat", comprises hull 12 dimensioned and configured as a surface-planing hull as known in the art. The hull may be constructed of an appropriate marine grade aluminum alloy. Cover or topskin 16 extends upwardly from the gunwale 14, wrapping around the deck and defining an encircled, partially open-top area 18 above the deck in which the operating crew and other personnel aboard are located. The cover 16 may be constructed of a foam-cored composite, and is chosen and dimensioned to insure that the center of buoyancy of the vessel remains above the vessel's center of gravity irrespective of the degree of fill of the ballast tanks to maintain the vessel in an upright orientation at all times when underwater and transitioning between surface and submerged states. Hatches 34 may be provided for rapid personnel and equipment egress during submerged operation to enhance diver safety. Lift points 32 allow the vessel to be raised from or lowered to the surface from a mother vessel, helicopter, or the like.

Surface drive for the vessel is provided for by a high efficiency marine engine located amidships in engine enclosure 20. The enclosure, which is mounted to the hull, provides a seated, water-tight compartment for the engine and associated equipment, and may be constructed in accordance with the disclosure of co-pending U.S. patent application Ser. No. 10/960,523, the contents of which are incorporated by reference herein. The engine enclosure incorporates appropriate seals and valves for engine combustion air, cooling and exhaust to fully protect the engine and related water-sensitive systems when submerged, and to allow rapid engine restart when on the surface. The engine driveshaft may be coupled to a water jet propulser system, providing speeds to a maximum of about 35+ knots. The hull may be configured with a tunnel 30 as known in the art to accommodate the jet drive. The vessel's helm 22 is positioned to the aft of the engine, and includes a surface console having the controls and instrumentation to operate the craft. The controls are conventional, and may include steering, throttle, jet bucket and gear selection, along with engine instrumentation, navigation and communication gear. The controls and instrumentation are waterproofed as known in the art to protect them from water ingress when the vessel is submerged.

The craft includes a multi-component buoyancy control system, formed of two ballast systems, to regulate the craft's buoyancy in accordance with on-going requirements, allowing the vessel to be trimmed for either planing surface travel or low speed travel in a lowered profile condition; to assume a further lowered-profile awash condition preparatory to descent and upon initial arrival at the surface upon ascent; to sink; re-float; and to establish neutral buoyancy. A first ballast system controls transition between a surface running condition and the awash condition, and may include three independent open ballast tank sub-systems. The first subsystem comprises fourteen open ballast tanks 24, arranged in two rows of seven tanks each on each beam. The tanks on each side are configured to provide sufficient volume to establish up to 6000 pounds/2720 kg total buoyancy. The tanks on both beams may be ganged together, and controlled through a single control valve and high-pressure air line. The main valve may be a three-way valve, allowing the operator to blow high-pressure air into the tanks, vent the tanks completely, or maintain a desired volume of air.

The first ballast system also includes second and third independent ballast subsystems. The second, forward subsystem comprises an open ballast tank 26 at the craft's bow, while the third, aft subsystem comprises a pair of open ballast tanks 28 at the stern. The second and third subsystems allow the bow and stern to be independently raised or lowered as desired during transition; each of the second and third subsystems is also provided with valves and piping to permit the operator to fill and empty each subsystem independently as may be required.

The second ballast system adjusts the submerged depth, attitude and rate of descent and ascent of the vessel to and from the awash condition. It comprises a stern closed ballast tank 36 located between the stern open ballast tanks 28, and a pair of closed bow ballast tanks 38 forward of the beam open tanks 24 and just aft of the bow open tank 26. As with the tanks of the first ballast system, the tanks of the second ballast system are provided with appropriate valving and piping to permit the operator to fill and empty the tanks of compressed air to control the descent and ascent. Because the tanks are closed rather than open, they are also provided with sea valves to control the passage of water into and out of the tanks in conjunction with the fill and venting of compressed air. The forward tank may have a volume of about 5 cubic feet while the aft tanks are each of a volume of about 3 cubic feet.

As depicted, the vessel may require a crew of two, a pilot and a navigator. In addition to the crew, six other personnel may be accommodated as part of a useful load of about 4,200 pounds. At full load maximum displacement is about 11,500 pounds. The vessel may have an overall length of about 30 feet, with a height of 6 feet and a maximum beam of 8 feet. Lift points 32 may be provided to allow the craft to be airlifted or otherwise transported to and from an initial water-entry point, the craft having a surface cruise range on the order of 150 nautical miles at a speed of 32 knots.

High pressure air for the ballast systems is provided by a pair of reserve tanks 40 coupled to the ballast tanks through the piping system. Each tank may be capable of storing 230 cubic feet of air at a pressure of 3300 psi. Such a volume of air is sufficient in the present embodiment to allow two submerge-resurface cycles with sufficient reserve for a third, emergency transition set. Preferably, the tanks are filled by shore service or other means external to the vessel prior to a mission, thus avoiding the need for an on-board compressor. Normally-closed in-line valves 42 may be located as appropriate along the piping connecting the elements of the ballast systems to allow isolation of individual tanks in the event of leakage or other damage or failure.

With appropriate trim and freeboard established for surface travel, the vessel performs as a planing craft, allowing rapid deployment and high maneuverability. As an underwater mission debarkation point is approached, the speed of the vessel is reduced and hull doors 44 at the aft of the vessel are opened to allow water to start to flood the hull, lowering the freeboard of the craft to lessen the above-water profile of the craft. Hull doors may also be provided at the bow of the vessel to increase the rate of water entry. The craft is maintained in the lowered profile orientation by the buoyancy of the first and second ballast systems, the tanks of which are substantially water-free. The craft can continue to travel at a reduced rate of speed in the lowered profile condition.

When the debarkation point is reached, the engine is shut down and sealed off. The first ballast system is then operated, venting air from its tanks and further lowering the profile of the craft to an awash condition as the hull is further flooded through the hull doors. Once the awash condition is reached the second ballast system is operated, venting air from the closed tanks and opening the tanks' sea valves. The tanks take on additional ballast water and the vessel descends underwater. The rate of descent and the attitude of the vessel can be controlled by appropriate adjustment of the second ballast system's tanks' venting and fill, as the fore and aft tanks can be individually controlled. Once an appropriate descent rate is achieved the sea valves can be closed to avoid depth-induced changes in buoyancy. Either neutral or slight negative buoyancy can be obtained as required to allow the craft to remain at a particular depth or rest on the ocean floor. With the vessel fully submerged the operations personnel can leave the vessel for the mission through the hatches 34. The maximum operational depth of the craft is about 66 feet. It is within the contemplated scope of the invention that means can be provided to provide for limited maneuvering when submerged to avoid, for example, an observed hazard on the sea floor.

When the personnel return, compressed air is ported into the second ballast system's tanks and their sea valves opened to discharge the tanks' water to bring the craft to the surface, adjusting the attitude of the craft as it rises as may be needed. In an emergency condition the tanks of the first ballast system can also be utilized to rapidly return the craft to the surface. The buoyancy distribution created and maintained by the cover 14 insures that the craft remains in an upright orientation irrespective of the distribution of load as the ballast tanks fill with air and the overall buoyancy of the vessel is increased. The craft is raised to the awash state. Once the awash state is reached, compressed air is ported into the tanks of the first, open ballast system, raising the profile and freeboard of the vessel sufficiently to allow the engine to be reconfigured for operation and restarted, while maintaining a low surface profile. As the craft gets under way remaining hull water drains out through the hull doors 44 as the bow rises as the speed increases. When sufficient water is drained the hull doors are closed and the vessel is again watertight for full surface functionality.

I claim:

1. A surface-planing vessel having submersion/resurfacing capabilities, comprising:

a floodable hull having provision for a payload;

a single propulsion system having a single engine means, said means adapted and provided solely for driving the vessel only during surface operation and not during submerged operation;

means for selectively isolating the engine from internal ambient water ingress and external ambient water contact within a surrounding engine enclosure when the vessel is submerged;

a ballast system for controlling underwater descent and ascent of the vessel; and means for effecting a buoyancy distribution to maintain vessel stability during transition between surface and submerged states.

2. The vessel of claim 1 wherein the ballast system comprises open and dosed ballast tanks connected to a source of compressed air.

3. The vessel of claim 1 wherein the ballast system includes a first ballast system for controlling transition between surface running and awash conditions and a second ballast system for adjusting the depth, attitude and rate of descent and ascent of the vessel.

4. The vessel of claim 3 further comprising a ballast system for adjusting the freeboard of the vessel during surface operation.

5. The vessel of claim 4 wherein the ballast system for adjusting the freeboard of the vessel comprises the first ballast system.

6. The vessel of claim 3 wherein the first ballast system comprises open ballast tanks and the second ballast system comprises closed ballast tanks.

7. The vessel of claim 6 wherein the first ballast system comprises first, second and third independently fillable ballast tank subsystems.

8. The vessel of claim 7 wherein the first tank subsystem has tank means located along beams of the vessel, the second subsystem has tank means located at a bow of the vessel, and the third subsystem has tank means located at an aft of the vessel.

9. The vessel of claim 6 further comprising a refillable reservoir of compressed air coupled to the first and second ballast systems.

10. The vessel of claim 1 wherein the means for effecting the buoyancy distribution comprises a non-compressible volume of positive buoyancy means.

11. The vessel of claim 10 wherein the means for effecting the buoyancy is a cover extending upwardly from the hull.

12. The vessel of claim 11 wherein the cover is of a foam core composite.

13. The vessel of claim 12 wherein the cover has hatched for personnel egress when submerged.

* * * * *